United States Patent [19]

Balzer et al.

[11] Patent Number: 4,654,245

[45] Date of Patent: Mar. 31, 1987

[54] ROLL UP FLOOR MAT

[75] Inventors: Claude P. Balzer; Roger L. Rumsey, both of Wichita, Kans.

[73] Assignee: Balco, Inc., Wichita, Kans.

[21] Appl. No.: 859,863

[22] Filed: May 2, 1986

Related U.S. Application Data

[63] Continuation of Ser. No. 645,245, Aug. 29, 1984, abandoned.

[51] Int. Cl.[4] ..... E04C 1/30; E04F 15/16

[52] U.S. Cl. ..... 428/52; 52/71; 52/177; 52/586; 428/58; 428/85; 428/192

[58] Field of Search ..... 428/52, 57, 58, 62, 428/192, 85, 44; 52/71, 177, 181, 585, 586; 15/237, 238, 215; 160/231 A, 231 R

[56] References Cited

U.S. PATENT DOCUMENTS 3,422,878 1/1969 Galietti ..... 160/231 A

*Primary Examiner*—Paul J. Thibodeau

*Attorney, Agent, or Firm*—Schmidt, Johnson, Hovey & Williams

[57] ABSTRACT

A roll up floor mat is provided with rails or sections hingedly interconnected by alternating, flexible strips, which, in turn serve to cushion the mat by use of laterally extending flaps interposed between the floor or other supporting surface and the rail sections, the flaps being integral with the hinge assemblies between the sections.

3 Claims, 9 Drawing Figures

ROLL UP FLOOR MAT

This application is a continuation of application Ser. No. 06/645,245, filed 8/29/84 now abandoned.

BACKGROUND OF THE INVENTION

The present invention relates to a floor mat capable of being rolled up for storage and cleaning, and relates to co-pending U.S. application Ser. No. 305,445, filed Sept. 25, 1981, now U.S. Pat. No. 4,568,587 and assigned to the assignee hereof, as well as to U.S. Pat. No. 4,381,324, filed Mar. 9, 1982.

In the floor mat of U.S. Pat. No. 4,381,324 it is stated that "an underlying cushion effect may be achieved by having resilient rib members—partially embedded into corresponding grooves", there being two such grooves in each of the sections.

In U.S. Pat. No. 4,568,587, each of a pair of lower passageways in each rail respectively slidaby receive an elongated cushion of "durable, resilient material such as vinyl".

As an improvement thereon, we have eliminated the need for grooving the lower faces of the rail sections and the need for a multitude of separate cushions, separately installed, by flanging each hinge web and providing a flap on each flange disposed to flex into engagement with the rail section thereabove in response to laying of the mat on the floor.

IN THE DRAWINGS

DETAILED DESCRIPTION OF THE DRAWINGS

Figure 1:
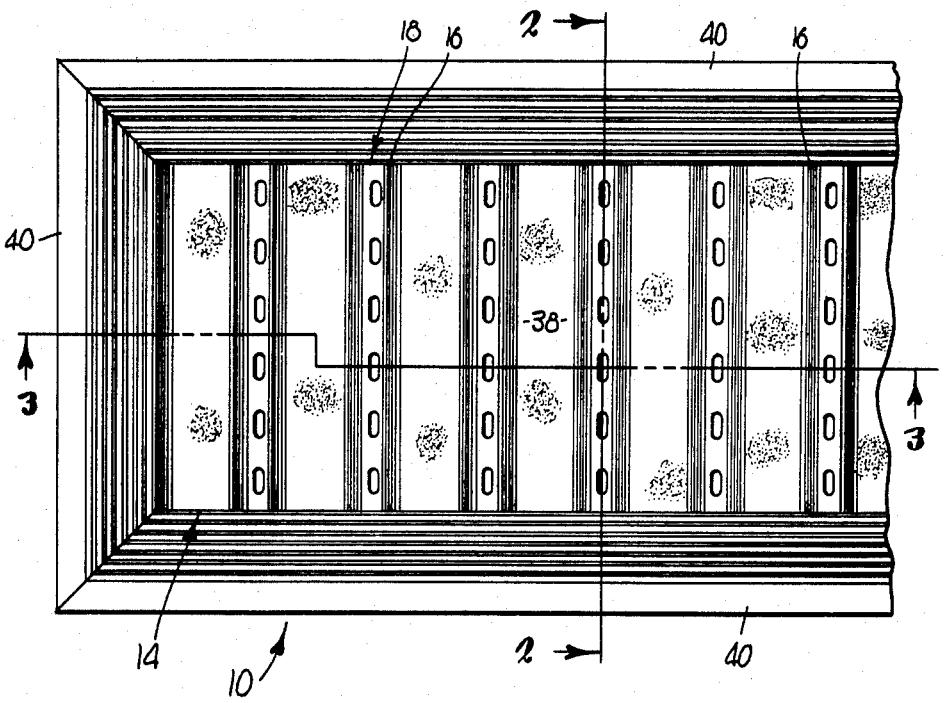
FIG. 1 is a fragmentary plan view of a roll up floor mat made pursuant to our present invention.
Figure 2:
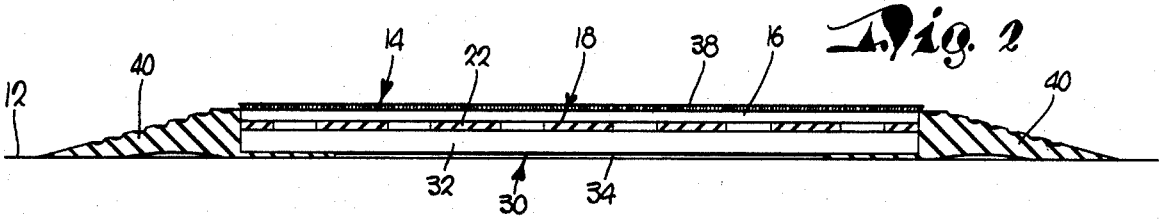
FIG. 2 is an enlarged cross-sectional view taken on line 2—2 of FIG. 1.
Figure 3:
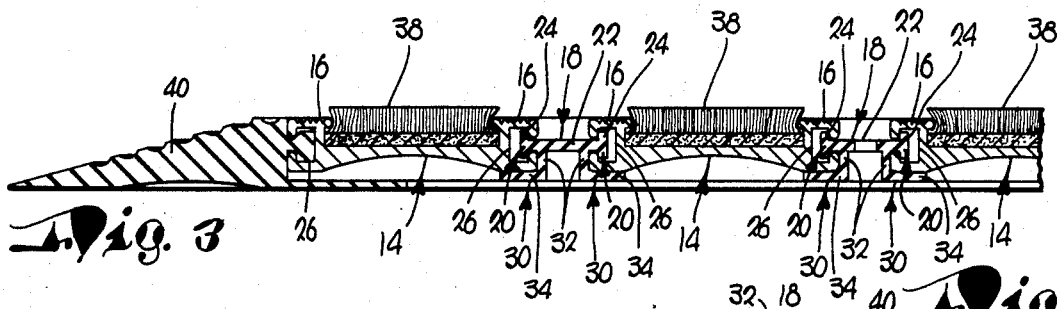
FIG. 3 is a fragmentary cross-sectional view taken on line 3—3 of FIG. 1.

The roll up floor mat shown in FIGS. 1-6 of the drawings, designated by the numeral 10, is adapted for placement on a normally horizontal support surface 12 such as a floor or sidewalk, and includes a plurality of elongated, spaced apart, rectangular, rigid, metallic, plate-like rails or sections 14, such as extruded aluminum, each provided with a pair of opposed, longitudinal extremities 16. A number of elongated, flexible, elastomeric strips 18, e.g. vinyl, alternate with the rails 14, the rails 14 and the strips 18 being coextensive in length. T-joints 20 releasably interlock the strips 18 and the rails 14 along the extremities 16.

Each strip 18 includes a median, bendable web 22, together with a pair of spaced apart, opposed, transversely T-shaped connectors 24 integral with the webs 22. The extremities 16 are provided with undercut, inwardly opening, transversely C-shaped grooves 26 coextensive in length with the extremities 16. The connectors 24 conform in transverse cross-section with the transverse cross-sectional configuration of the grooves 26 and slidably extend into corresponding, proximal grooves 26.

The mat 10 is also provided with a series of elongated, relatively thin, resilient cushions underlying the joints 20, such cushions being coextensive in length with the rail sections 14, the webs 22 and the joints 20. To this end, each strip 18 includes a pair of horizontally spaced, transversely L-shaped members 30, presenting, in each instance, an upstanding flange 32 between the extremities 16, the flanges 32 being integral with the corresponding webs 22. Additionally each strip 18 has a cushioning flap 34 integral with its flange 32.

The flaps 34 extend laterally in opposite directions beneath the rail sections 14 and, more particularly, beneath the T-joints 20. It is to be preferred that the flaps 34 be relatively narrow and be disposed to flex into flat engagement with the rails 14 along the proximal lowermost margins of the rails 14 at the extremities 16 in response to laying of the mat 10 on a floor or other surface, as indicated at 12 in FIG. 2.

Each of the rails 14 is provided with a length of carpeting 38 or other fibrous material, releasably connected with the rails 14, as illustrated, or in any other suitable manner. Additionally, if desired, the mat 10 may be provided with a vinyl frame border 40 coupled therewith through use of a T-joint comparable in nature to the joints 20.

Figure 5:
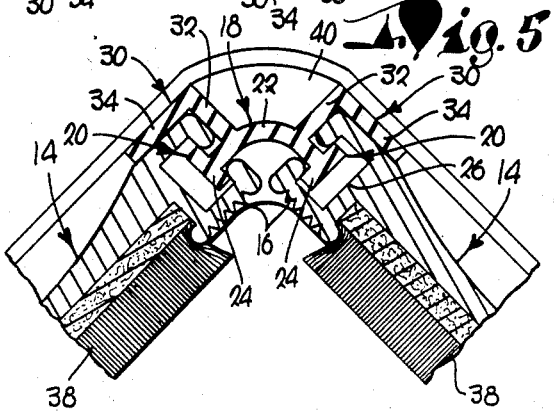
FIG. 5 is a cross-sectional view comparable to FIG. 4 but showing one pair of the rail sections and the corresponding hinge connection during roll up of the mat.
Figure 6:
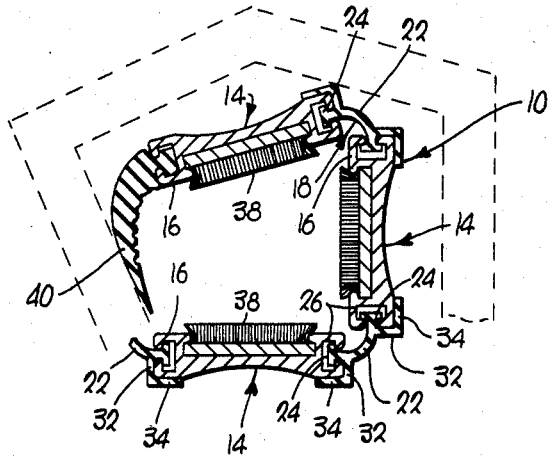
FIG. 6 is a cross-sectional view through a portion of the mat when the same is in its rolled condition.
Figure 7:
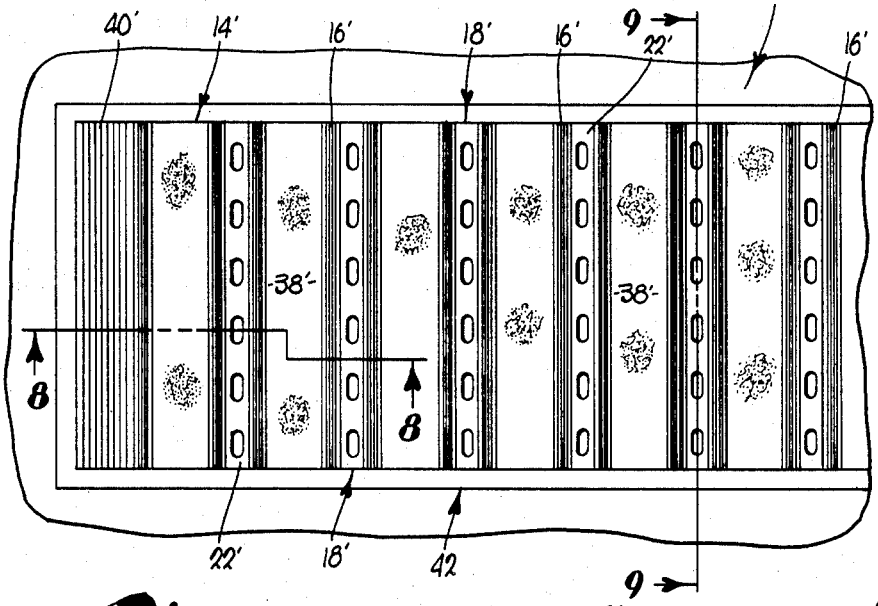
FIG. 7 is a view similar to FIG. 1, but showing the same recessed into a support surface.

FIGS. 5 and 6 illustrate the way in which the webs 22 bend in hinge-like manner when the mat 10 is to be removed from the surface 12 and rolled up into a single coil for initial shipment and for subsequent storage and/or cleaning, the joints 20 all the while maintaining the rail sections 14 in interconnected relationship.

Figure 8:
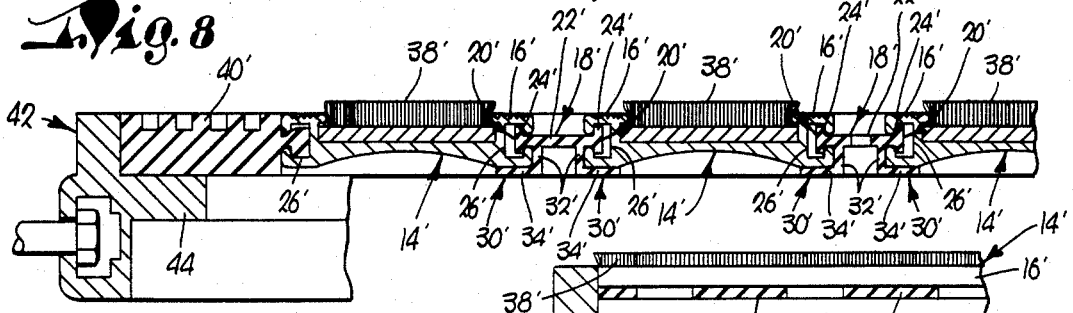
FIG. 8 is an enlarged, fragmentary, cross-sectional view taken on line 8—8 of FIG. 7.
Figure 9:
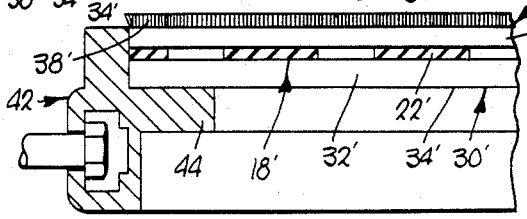
FIG. 9 is a fragmentary, cross-sectional view taken on line 9—9 of FIG. 7.

Except only for a slightly different type of border or vinyl filler 40', the floor mat 10' may be identical with the mat 10 and the same numerals, suitably primed, designate identical components. As best seen in FIGS. 8 and 9 the mat 10' is adapted to be recessed below the floor or other surface and, to this end, a suitable extruded aluminum frame 42 surrounds the mat 10', there being a continuous, inwardly extending rib or lip 44 forming a part of the frame 42 and disposed to support proximal rail sections 14'. In this instance, the flaps 34' at both ends of all of the rails 14' lie flatly on the proximal length of the rib 44.

Figure 4:
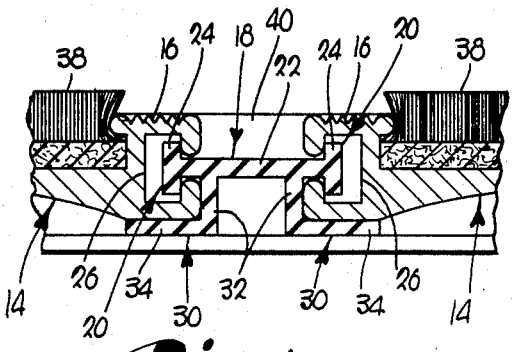
FIG. 4 is a fragmentary detail cross-sectional view similar to FIG. 3 but still further enlarged.

Accordingly, when the rails are interconnected by the connectors 24 sliding into the grooves 26, the flanges 32 are automatically disposed between the proximal extremities 16, and the flaps 34 are automatically disposed beneath the sections 14 as is clear, for example, in FIGS. 4 and 8, making it unnecessary to groove or recess the lower surfaces of the rails and unnecessary to provide separate cushions, requiring separate installation, reducing the overall cost of the assembly and providing an even better cushioning effect than has heretofore been suggested.

Having thus described the invention, what is claimed as new and desired to be secured by Letters Patent is:

1. In a roll up floor mat, the combination of:

a plurality of elongated, spaced apart, rigid, metallic, normally horizontal, parallel rails, each provided with a tread surface and a pair of opposed longitudinal, normally horizontal extremities, each extremity having an undercut, inwardly opening, transversely C-shaped groove coextensive in length therewith; and a number of elongated, flexible, elastomeric strips alternating with the rails and coextensive in length therewith, each strip including:

a mediun, normally horizontal, normally flat, bendable web, a pair of spaced apart, opposed, transverse T-shaped connectors extending laterally in opposite directions from the web, integral with the web, conforming in transverse cross-section with the transverse, cross-sectional configuration of said grooves and slidably extending into corresponding, proximal grooves in interconnecting relationship to a pair of said rails, and a pair of horizontally spaced, transversely L-shaped members, each presenting an upstanding flange beneath the web, between said extremities in engagement with the latter and integral with the web, together with a normally horizontal, floor-engaging, cushioning flap integral with each flange respectively, said flaps extending laterally in opposite directions from the flanges and being disposed beneath the rails and below the connectors in vertically spaced relationship to the latter.

2. The invention of claim 1, each flap being free to flex into flat engagement with the rails along the proximal loermost margins of the rails at said extremities in response to laying of the mat on said floor.

3. A roll up floor mat, comprising:

a plurality of elongated, spaced apart, normally horizontal, parallel rails, each provided with an upper tread surface and a pair of opposed, longitudinally extending, normally horizontal extremities, each extremity having structure defining an elongated marginal groove presenting a relatively narrow, elongated entrance opening and an elongated, enlarged zone in communication with said entrance opening; and a number of elongated, flexible, elastomeric strips alternating with the rails and substantially coextensive in length therewith for interconnecting the rails, each strip including:

a median, normally horizontal, normally flat, bendable web having a thickness and a pair of opposed side margins;

a pair of spaced apart, marginal connectors integral with said web and extending from the side margins of the web, each of said connectors comprising an enlarged head portion having a width greater than said thickness of the web, said head portions substantially conforming in transverse cross section with the transverse cross-sectional configuration of the zones of said grooves, said connectors slidably extending into corresponding, proximal grooves in interconnecting relationship with a pair of said rails, the interconnecting strips being substantially coplanar when said rails are horizontally disposed; and a pair of normally horizontal, floor-engaging cushioning flaps integral with said strip, said flaps extending laterally of said web and each lying beneath a corresponding adjacent rail and below a proximal connector head in vertically spaced relationship to the latter.

* * * * *